US005122073A

United States Patent [19]

Del Signore, II et al.

[11] Patent Number: 5,122,073

[45] Date of Patent: Jun. 16, 1992

[54] CONNECTOR FOR COUPLING A PLURALITY OF DEVICES TO A CIRCUIT IN A PRINTER

[75] Inventors: James R. Del Signore, II, Trumansburg; Robert A. Brull, Dryden; Daniel J. Rabideau, Ithaca, all of N.Y.

[73] Assignee: NCR Corporation, Dayton, Ohio

[21] Appl. No.: 633,731

[22] Filed: Dec. 24, 1990

[51] Int. Cl.[5] ..... B41J 29/02

[52] U.S. Cl. ..... 439/218; 400/175; 400/692

[58] Field of Search ..... 439/217-224, 439/151; 400/692, 175

[56] References Cited

U.S. PATENT DOCUMENTS

| | | | |
|---|---|---|---|
| 2,288,241 | 6/1942 | Holcomb | 439/133 |
| 2,863,131 | 12/1958 | Carlzen | 439/607 |
| 3,466,591 | 9/1969 | Ecclesia | 439/61 |
| 3,736,471 | 5/1973 | Donze et al. | 439/59 |
| 4,388,010 | 6/1983 | Mott et al. | 400/692 |
| 4,444,519 | 4/1984 | Howell et al. | 400/82 |
| 4,595,303 | 6/1986 | Kuzuya et al. | 400/82 |
| 4,930,915 | 6/1990 | Kikuchi et al. | 400/692 |
| 4,985,806 | 1/1991 | Mazzullo | 361/393 |

OTHER PUBLICATIONS

RCA Technical Notes, Yannotti, TN No. 235, Jan. 1959.

*Primary Examiner*—Neil Abrams

*Attorney, Agent, or Firm*—Matthew R. Jenkins

[57] ABSTRACT

A connector for enabling a user to selectively couple one of at least a first printhead having a connection member or a second printhead having a set of connection members to a circuit. The circuit comprises first contact means for connecting the first printhead to the circuit and second contact means for connecting the second printhead to the circuit. The connector comprises a body having a first slot for receiving the connection member. The body further comprises a second slot and a third slot for receiving the set of connection members. A first plurality of male conductors is associated with the first slot in order to couple the first printhead to the first contact means of the circuit when the connection member is inserted into the first slot. A second plurality of male conductors is associated with the second and third slots in order to couple the second printhead to the second contact means of the circuit when the set of connection members are inserted into the second and third slots, respectively.

7 Claims, 5 Drawing Sheets

CONNECTOR FOR COUPLING A PLURALITY OF DEVICES TO A CIRCUIT IN A PRINTER

BACKGROUND OF THE INVENTION

1. Field of the Invention

This invention relates to a connector, and more particularly, this invention relates to a connector for selectively coupling one of at least a first printhead or a second printhead to a circuit in a printer.

2. Description of Related Art.

Many electronic devices of the prior art included components which could not be easily changed or replaced. For example, some printers included a single printhead which was permanently mounted in the printer. In some printers, a receptacle-type connector was permanently mounted in the printer to permit a printhead to be "plugged" into the connector. These receptacle-type connectors did not permit printheads having different plug configurations from being inserted into the connector. Also, the connectors of the prior art were not capable of accepting printheads having different electrical connection requirements. In order to substitute a printhead in the printer having different electrical connection requirements, it was necessary to replace the entire connector. In some instances, this would also require the replacement of an entire printer carriage or circuit board on which the connector was mounted. These changes would have to be made by a field engineer or technician. Accordingly, a user could not easily change the printhead in the printer without spending a considerable amount of time and money.

SUMMARY OF THE INVENTION

It is therefore an object of the present invention to provide a connector for permitting a user to selectively couple one of at least a first printhead or a second printhead to a circuit in a printer.

In one aspect of the invention, there is provided a connector for selectively coupling one of at least a first device or a second device to a circuit, said first device having first connection means and the second device having second connection means; said circuit comprising: first contact means for connecting the first device to the circuit; second contact means for connecting the second device to the circuit; said connector comprising: a body; receiving means located on the body for receiving either the first connection means or the second connection means; first coupling means associated with the receiving means for coupling the first device to the first contact means when the first connection means is inserted into the receiving means; and second coupling means associated with the receiving means for coupling the second device to the second contact means when the second connection means is inserted into the receiving means.

An advantage of this invention is that it enables a user to quickly and easily change an electronic device, such as a printhead in a printer, without having to replace a printer carriage or a circuit board on the printer carriage.

Another advantage of this invention is that it provides a connector that will accommodate at least two printheads having different electrical connection requirements.

Another advantage of this invention is that it provides a connector for permitting a user to selectively couple one of at least a first device or a second device to a circuit.

Still another advantage of this invention is that it permits printheads having different electrical connection requirements to be interchanged without disturbing the quality of the printing of the printer; and Yet another advantage of this invention is that it permits a printer to be easy and inexpensive to manufacture, assemble and repair because the printheads can be easily mounted in or removed from the printer.

DESCRIPTION OF THE PREFERRED EMBODIMENT

Figure 1:
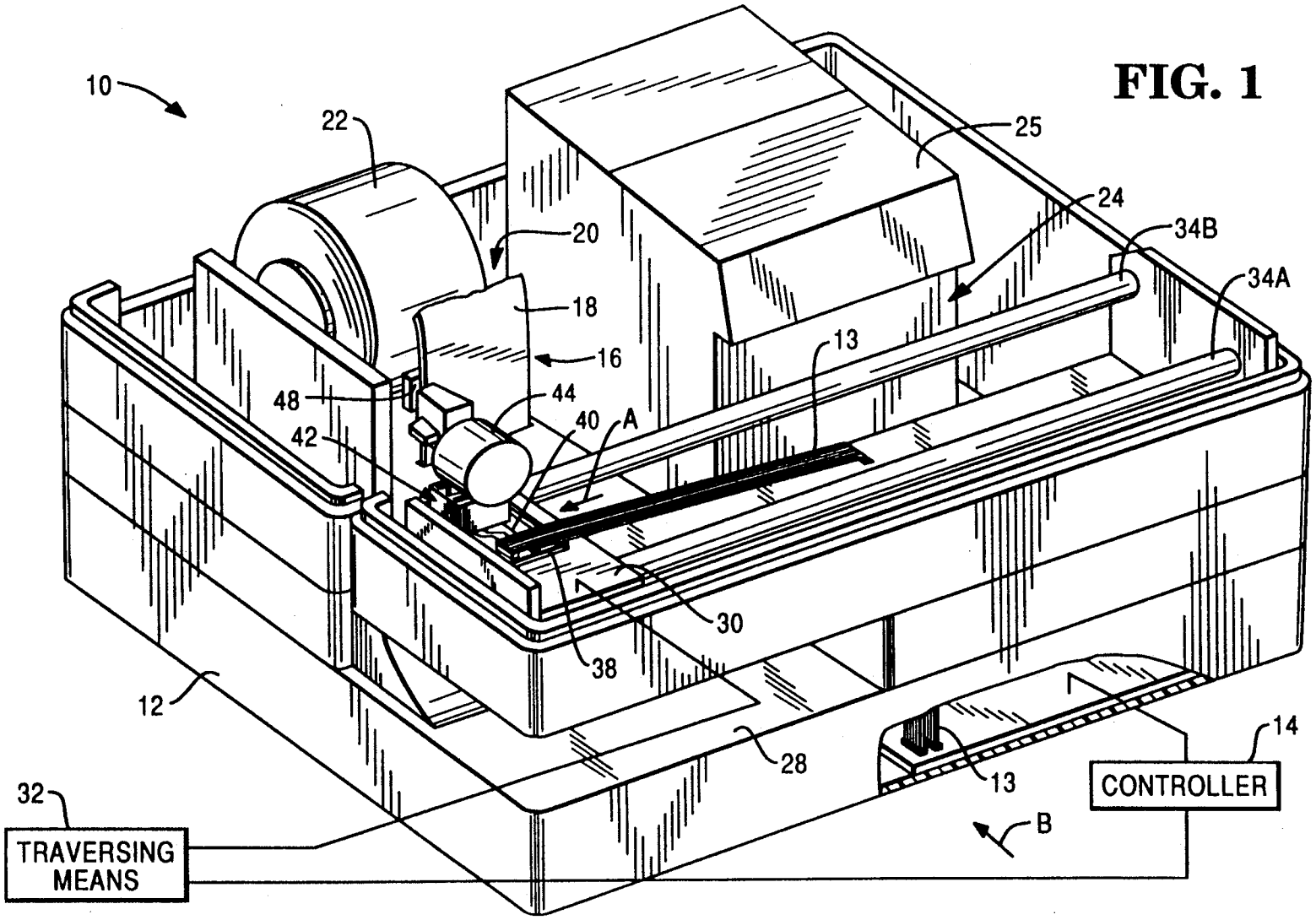
FIG. 1 is a partly broken away general perspective view of a printer, showing a print station and a printer carriage with a dual printhead connector mounted thereon and a first printhead mounted in the dual printhead connector.

FIG. 1 is a general perspective view of a preferred embodiment of a printer, designated generally as printer 10. The printer 10 comprises a housing 12 and a controller 14 which provides electrical signals for controlling the operation of the printer 10. A suitable controller is comprised of model #8052, manufactured by Intel Corporation of Santa Clara, Calif., as well as other associated electromechanical control electronics (not shown). The printer 10 also includes a print station 16 for printing the data 50 (FIG. 2) on a receipt document 18 (FIGS. 1 and 2) at a receipt station 20 (FIG. 1) or on journal paper (not shown) at a journal station 24. In a preferred embodiment, the receipt document 18 is supplied from a paper supply roll 22 positioned at the print station 16. The journal paper (not shown) is conventionally supplied from a supply roll (not shown) which is mounted inside the journal housing 25 (FIG. 1). A slot 28 is provided at the left front of the printer 10 (when looking in the direction of arrow B in FIG. 1) in order to print on, for example, a slip (not shown) when the slip is inserted through the slot 28 into the print station 16 from the front of the printer 10.

Figure 2:
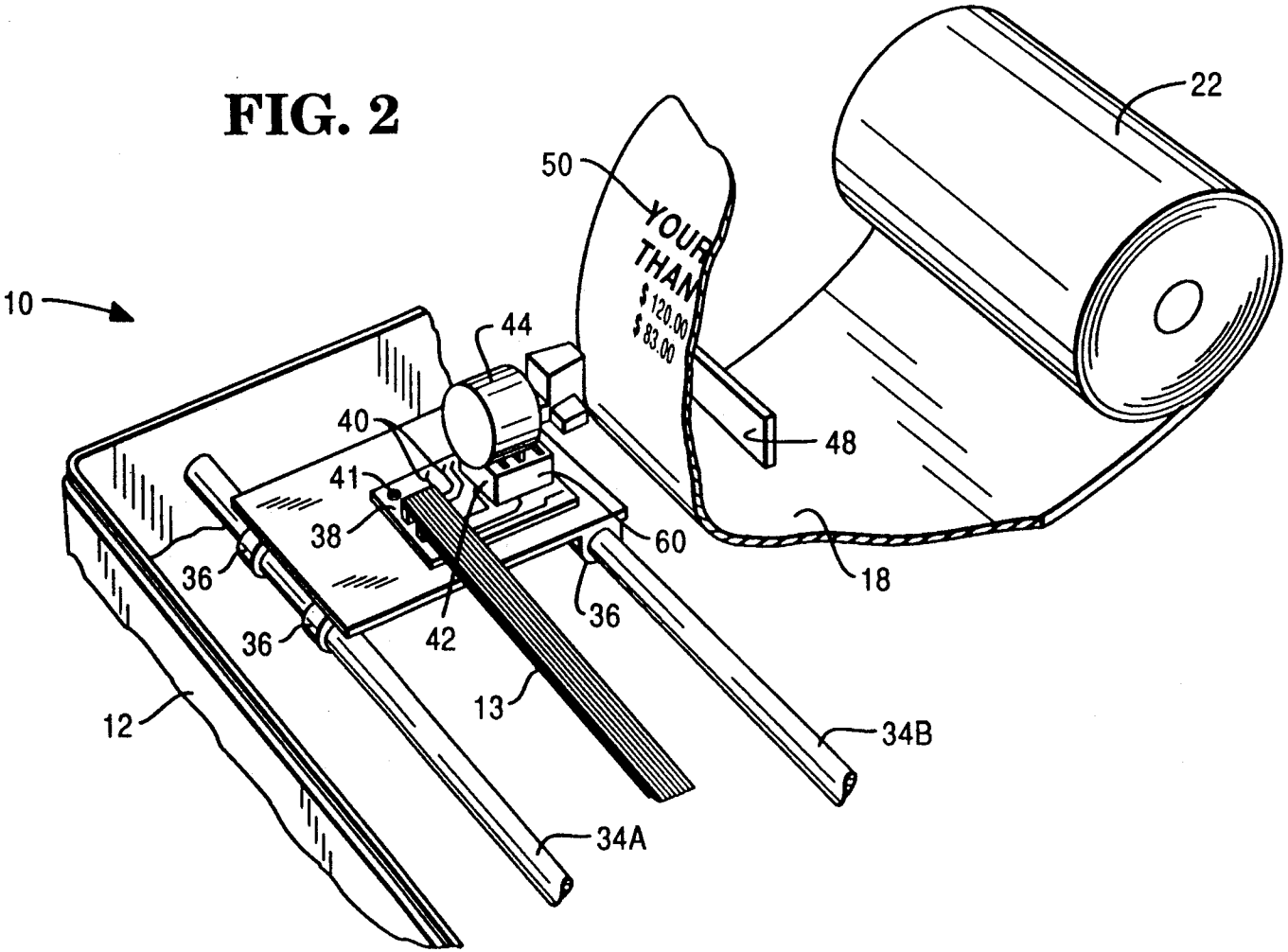
FIG. 2 is a fragmentary perspective view of a portion of the printer shown in FIG. 1, showing more details of the printer carriage, the dual printhead connector and the first printhead.
Figure 3:
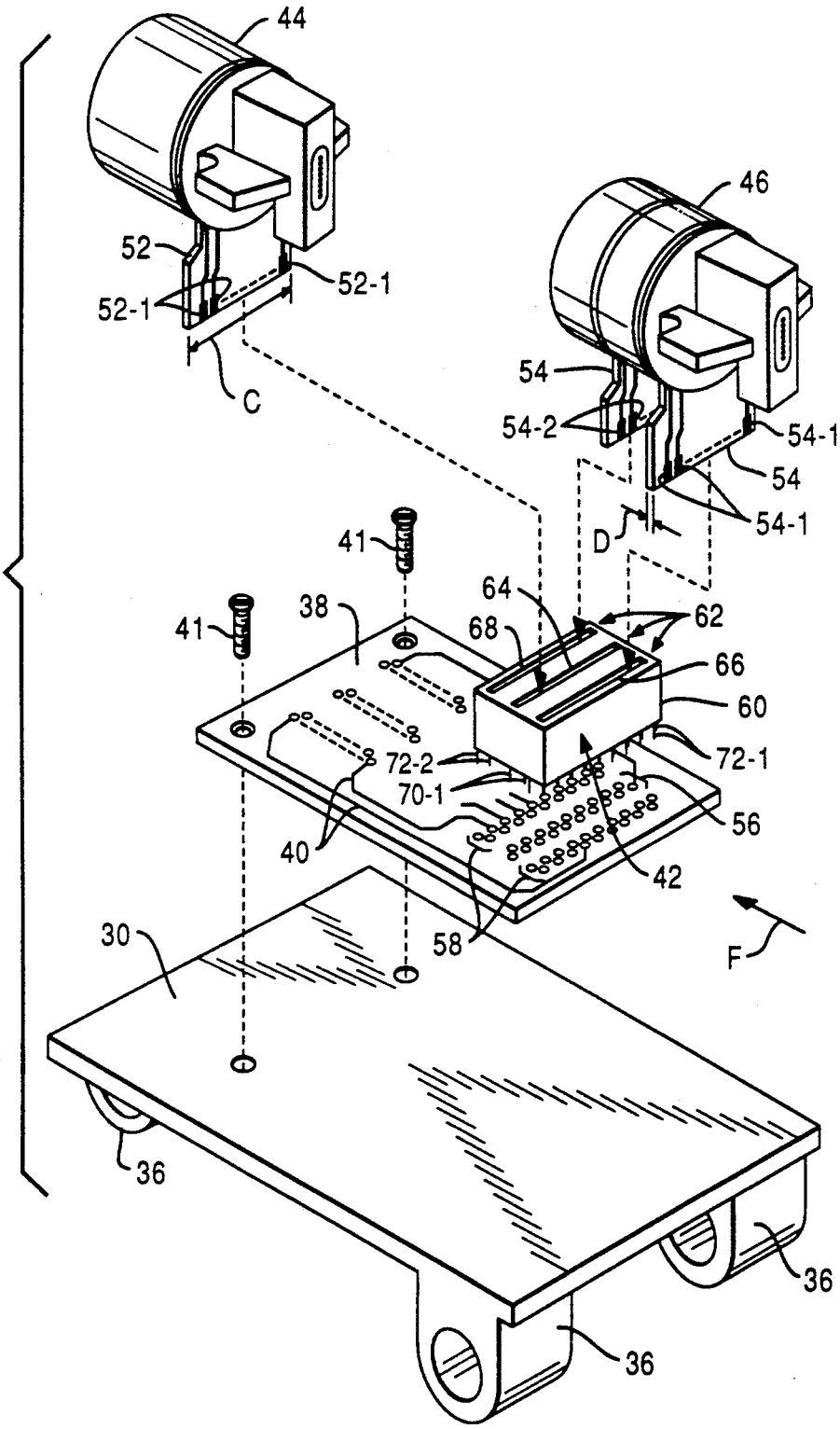
FIG. 3 is an exploded view of the dual printhead connector mounted on a circuit board, showing how either the first printhead or the second printhead can be selectively mounted in the dual printhead connector.

The print station 16 includes a printer carriage 30 which is coupled to traversing means 32 for traversing the printer carriage 30 in a side-to-side manner across the print station 16 and the journal station 24. The traversing means 32 includes the support rods 34A and 34B, respectively, which are conventionally secured to the housing 12. The printer carriage 30 is slidably mounted directly onto the support rods 34A and 34B by any suitable means, such as circular bushings 36 (FIGS. 2 and 3). The traversing means 32 also includes a carriage drive motor (not shown) which is coupled to the controller 14. The carriage drive motor is coupled to the printer carriage 30 by a timing belt and pulleys (not shown). The controller 14 energizes the carriage drive motor to move the carriage 30 across the print station 16 in a side-to-side manner so as to effect printing at either the receipt station 20 or the journal station 24 (FIG. 1).

As best shown in FIGS. 1–3, the printer carriage 30 comprises a circuit board 38 having a circuit 40 mounted thereon. The circuit 40 is electrically interconnected to circuitry (not shown) of controller 14 by way of flexible cables 13 and associated interconnect hardware (not shown). The circuit board 38 is conventionally mounted to the carriage 30 by suitable fasteners, such as integral plastic snaps (not shown) or screws 41 (FIG. 3). The circuit board 38 has a dual printhead connector, hereinafter referred to as connector 42, secured thereto for coupling one of at least a first printhead 44 or a second printhead 46 to the circuit 40. In a preferred embodiment, the first printhead 44 is an Epson Model 90B 9-wire dot matrix printhead, manufactured by Epson Computer of Torrance, Calif. The second printhead 46 is an Epson Model 240I 24-wire dot matrix printhead which is also manufactured by Epson Computer. The first and second printheads 44 and 46 cooperate with a platen 48 (FIGS. 1 and 2) to print the data 50 on either the receipt document 18 or the journal paper (not shown) at the receipt station 20 (FIG. 1) or journal station 24, respectively. As best illustrated in FIG. 3, the first printhead 44 has first connection means comprising a single-sided pcb card edge finger or a connection member 52. In the embodiment being described, the second printhead 46 also has second connection means comprising a pair of single-sided pcb card edge fingers or a set of connection members 54. The connection member 52 has a first conductor 52-1, and the set of connection members 54 includes a second conductor 54-1 and a third conductor 54-2, as best shown in FIG. 3. The first, second and third conductors 52-1, 54-1 and 54-2 enable the first printhead 44 and the second printhead 46 to be coupled to the circuit 40. The connection member 52 and set of connection members 54 are generally planar and they depend from their respective printheads 44 and 46 approximately 0.5 inch, as best illustrated by double arrow E in FIG. 5, which is shown in enlarged scale. The connection member 52 and set of connection members 54 also have a typical width (indicated by double arrow C in FIG. 3) of 0.890 inch and a typical thickness (indicated by double arrow D in FIG. 3) of 0.012 inch. It will be understood that the connection member 52 could be in the form of a plurality of connectors, if desired, and that the set of connection members 54 could be in the form of a single connector or a different number of separate connectors, if desired.

A function of the circuit 40 (FIG. 3) is to connect the flexible cables 13 and controller 14 to the connector 42 and any other components (not shown), such as optical sensors (not shown), which may be mounted on the circuit board 38. Another function of the circuit 40 is to connect the flexible cables 13 and controller 14 (FIG. 1) to the connector 42 in order to couple the controller 14 to either the first or second printhead 44 or 46, respectively, depending on which printhead 44 or 46 is mounted in the connector 42. The circuit 40 has first contact means or a first set of nodes 56 (FIG. 3) for connecting the first printhead 44 thereto and second contact means or a second set of nodes 58 for connecting the second printhead 46 thereto.

The connector 42 (FIGS. 1–5) comprises a body 60 which is generally rectangular and which has dimensions of $1'' \times \frac{1}{2} \times 1\ \frac{1}{2}''$ in a preferred embodiment. The body 60 can be made from any suitable insulating material, such as plastic. The connector 42 also comprises receiving means 62 (FIG. 3) which provides a means for receiving either the connection member 52 or set of connection members 54. The receiving means 62 comprises a first aperture or slot 64 for receiving the connection member 52 in order to couple the first printhead 44 to the circuit 40. The receiving means 62 also comprises a second slot 66 and a third slot 68 for receiving the set of connection members 54 in order to couple the second printhead 46 to the circuit 40.

The connector 42 further comprises first coupling means 70 (FIG. 4) which is associated with the first slot 64 of the receiving means 62. The function of the first coupling means 70 is to couple the first conductor 52-1 of connection member 52 to the first set of nodes 56 of the circuit 40 when the connection member 52 is inserted into the receiving means 62. The first coupling means 70 includes a first plurality of male conductors 70-1 (FIGS. 3 and 5) which couple the first set of nodes 56 of circuit 40 to the first conductor 52-1 of connection member 52 when the connector 42 is mounted on the circuit board 38 and the connection member 52 is inserted into the first slot 64.

Figure 4:
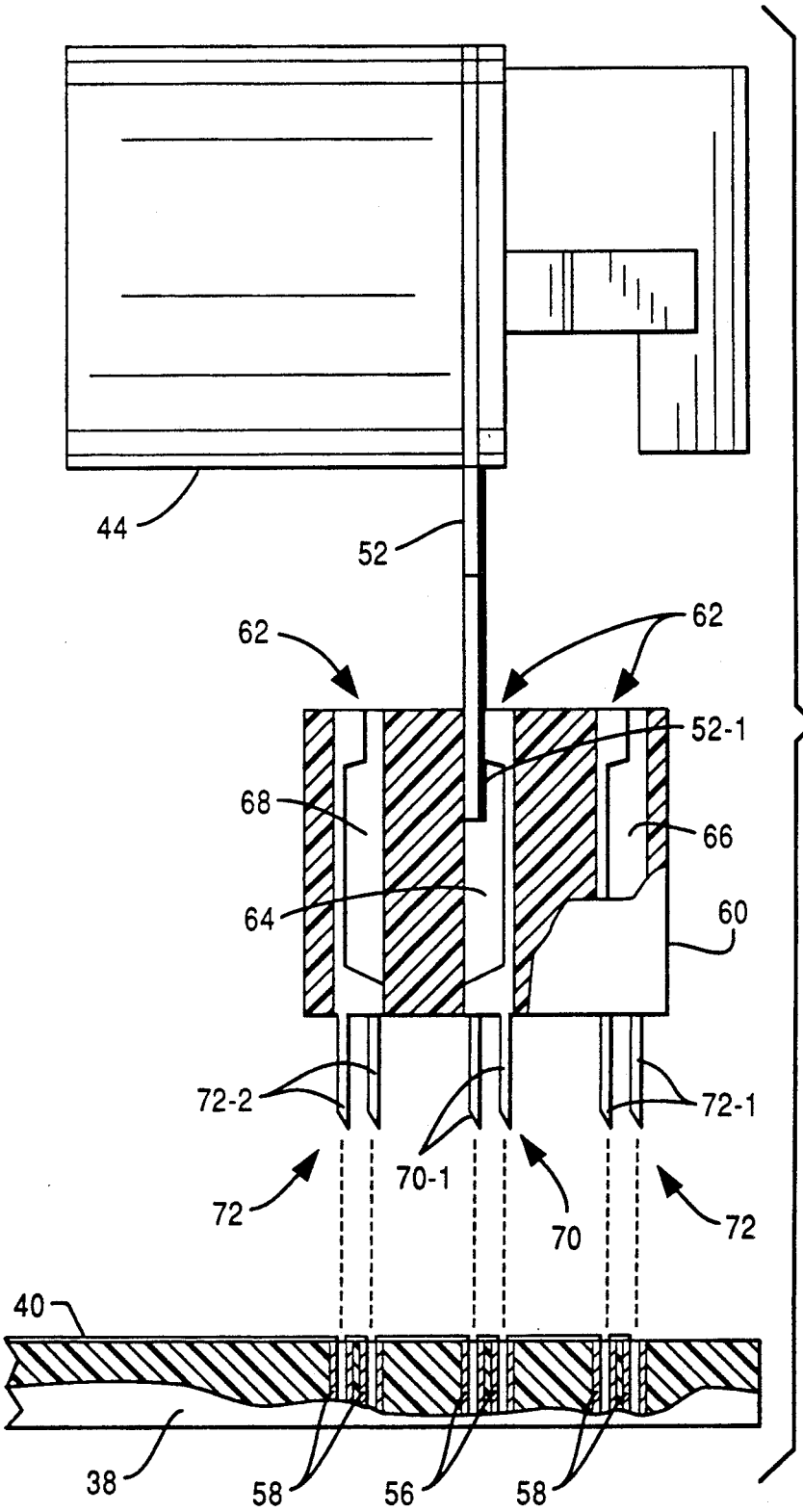
FIG. 4 is a side view of the circuit board, taken in the direction of arrow A in FIG. 1, showing a first connection means or connection member and a second connection means or set of connection members in the dual printhead connector.
Figure 5:
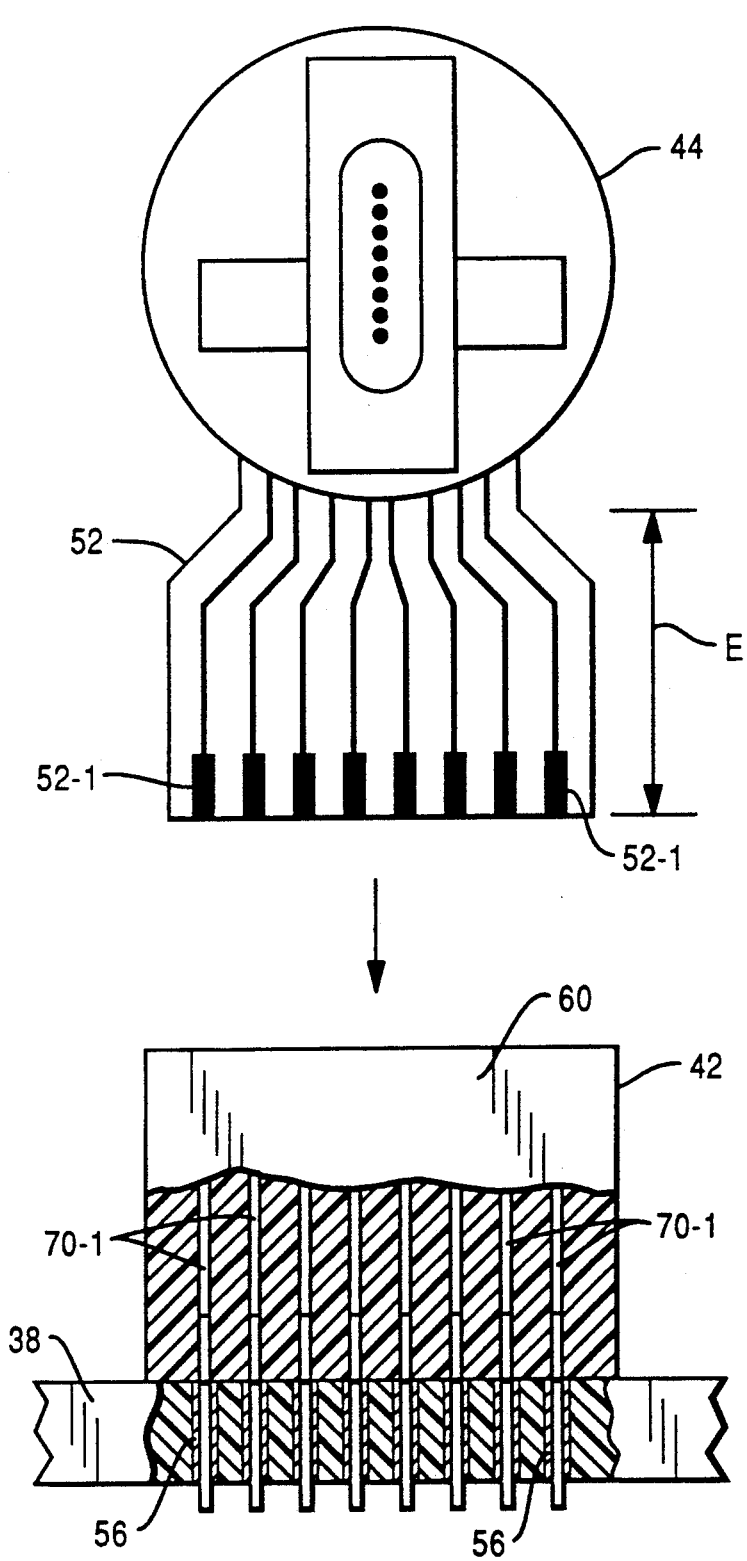
FIG. 5 is a partly broken away front view, taken in the direction of arrow F in FIG. 3, showing the first printhead in a raised position above the dual printhead connector.

The connector 42 also comprises second coupling means 72 (FIG. 4) which is associated with the second and third slots 66 and 68 of the receiving means 62. The function of the second coupling means 72 is to couple the second and third conductors 54-1 and 54-2 of the set of connection members 54 (FIG. 3) to the second set of nodes 58 of circuit 40 when the set of connection members 54 is inserted into the second and third slots 66 and 68, respectively. The second coupling means 72 (FIG. 4) includes a second plurality of male conductors 72-1 and 72-2 (FIGS. 3 and 4). As best shown in FIG. 3, the second plurality of male conductors 72-1 and 72-2 couples the second set of nodes 58 to the first and second conductors when the connector 42 is mounted on the circuit board 38 and the set of connection members 54 is inserted into the second and third slots 66 and 68. FIG. 5 is a partly broken away front view, showing a row of the first plurality of male conductors 70-1 integrally formed as part of the connector 42 and mounted onto the circuit board 38. The first and second plurality of male conductors 70-1, 72-1 and 722 depend from the bottom of the connector 42 (as viewed in FIG. 4) approximately 0.250 inch. The first and second plurality of male conductors 70-1, 72-1 and 72-2 are made of tin-plated berilyum-copper in a preferred embodiment, but they could be made of any suitable conductor which is capable of performing the same function. Also, the first and second plurality of male conductors 70-1, 72-1 and 72-2 are conventionally molded into the body 60 of the connector 42, and they may be secured to the circuit board 38 using conventional thru-hole printed circuit board technology, such as soldering.

The operation of the printer 10 will now be described. For purposes of illustration, assume that the first printhead 44 is mounted in the first slot 64 of connector 42. In order to print the data 50 (FIG. 2) on the receipt document 18 at the print station 16 (FIG. 1), the controller 14 energizes the traversing means 32 to move the printer carriage 30 in a side-to-side manner. The controller 14 also energizes the circuit 40 by way of the flexible cables 13 which in turn energizes the first printhead 44 to print the data 50 on the receipt document 18. It may be desired to replace the first printhead 44 (FIG. 3) with the second printhead 46, for example, because the first printhead 44 is broken or because the second printhead 46 provides more desirable printing characteristics. In order to replace the first printhead 44 with the second printhead 46, a user or field engineer would remove the first conductor 52-1 of the connection member 52 from the first slot 64 in the connector 42. The user would then mount the second printhead 46 into the connector 42 by aligning and inserting the second and third conductors 54-1 and 54-2 of the set of connection members 54 into the second and third slots 66 and 68, respectively, as best shown in FIG. 3. After the second printhead 46 is mounted in the connector 42, the first and second conductors 54-1 and 54-2 become operatively coupled to the second set of nodes 58. The second printhead 46 will be coupled directly to the circuit 40 so that it can be energized by the controller 14. In a similar manner, the second printhead 46 can be removed from the connector 42 and replaced by the first printhead 44 if desired.

While the invention has been described with reference to a specific embodiment, this description is merely illustrative, and it is not to be construed as limiting the scope of the invention. For example, the receiving means 62 could have slots 64, 66 and 68 which are shaped so as to be able to accommodate conductors 52-1, 54-1 and 54-2 which are not generally planar. Various other modifications and changes may occur to those skilled in the art without departing from the spirit and scope of the invention as defined by the appended claims.

What is claimed is:

1. A printer having a print station comprising:

a carriage;

a controller for controlling the operation of the printer;

traversing means coupled to said controller for moving said carriage across the print station;

a circuit board coupled to said controller and mounted on said carriage, said circuit board having a circuit thereon; and a connector for selectively coupling one of at least a first printhead or a second printhead to said circuit, said first printhead including a printing end and having first connection means comprising a generally rectangular member secured to said first printhead, and said second printhead including a printing end and having second connection means comprising a plurality of generally rectangular members secured to said second printhead;

said circuit comprising:

first contact means for connecting the first printhead to said circuit;

second contact means for connecting the second printhead to said circuit;

said connector comprising:

a body;

a plurality of receiving means comprising apertures of generally rectangular shape located in said body and positioned in parallel manner and spaced in tandem arrangement relative to said printing end of said first device or said second device for receiving either said first connection means or said second connection means;

first coupling means associated with one aperture of said plurality of receiving means for coupling said first printhead to said first contact means when said first connection means is inserted into said receiving means; and second coupling means associated with another aperture of said plurality of receiving means for coupling said second printhead to said second contact means when said second connection means is inserted into said receiving means;

said connector enabling a user to cause the printer to print when the first printhead when the user inserts said first connection means into one aperture of said plurality of receiving means;

said connector enabling a user to cause the printer to print with the second printhead when the user inserts said second connection means into another aperture of said plurality of receiving means.

2. The printer as recited in claim 1 wherein said first coupling means comprises a first plurality of male conductors which contact said first contact means when said connector is mounted to said circuit and said second coupling means comprises a second plurality of male conductors spaced from said first plurality of male conductors and which contact said second contact means when said connector is mounted to said circuit.

3. The printer as recited in claim 1 wherein said first connection means of said first device comprises a first conductor and said second connection means of said second device comprises at least a second conductor and a third conductor;

said receiving means having a first slot for receiving said first conductor and further having a second slot and a third slot for receiving said second and third conductors.

4. The printer as recited in claim 3 wherein said first coupling means comprises a first plurality of male conductors which are associated with said first slot in order to contact said first conductor when said first conductor is inserted into said first slot.

5. The printer as recited in claim 3 wherein said second coupling means comprises a second plurality of male conductors which are associated with said second and third slots in order to contact said second and third conductors are inserted into said second and third slots, respectively.

6. The printer as recited in claim 1 wherein said first printhead is a 9-wire matrix printhead and said second printhead is a 24-wire matrix printhead.

7. The printer of claim 1 wherein said connector includes a generally rectangular aperture therein for receiving said generally rectangular member and said connector includes a plurality of generally rectangular apertures therein spaced in parallel manner relative to said first-mentioned aperture for receiving said plurality of generally rectangular members.

* * * * *

UNITED STATES PATENT AND TRADEMARK OFFICE

CERTIFICATE OF CORRECTION

PATENT NO. : 5,122,073

DATED : June 16, 1992

INVENTOR(S) : James R. Del Signore, II et al.

It is certified that error appears in the above-identified patent and that said Letters Patent is hereby corrected as shown below:

Column 6, line 19, delete first occurrence "when" and substitute --with--.

Column 6, line 52, after "conductors" insert --when said second and third conductors--.

Column 6, line 55, after "9-wire" insert --wire--.

Column 6, line 56, after "24-wire" insert --wire--.

Signed and Sealed this

Seventeenth Day of August, 1993

Bruce Lehman

*Attest:*

BRUCE LEHMAN

*Attesting Officer*

*Commissioner of Patents and Trademarks*